US006097327A

United States Patent [19]

Byquist et al.

[11] Patent Number: 6,097,327

[45] Date of Patent: Aug. 1, 2000

[54] RADIO FREQUENCY ABSORBER SYSTEM

[75] Inventors: Tod A. Byquist, Tukwila; Peter Konis, Bainbridge, both of Wash.; Donald B. Spencer, Merrimack, N.H.

[73] Assignee: The Boeing Company, Seattle, Wash.

[21] Appl. No.: 09/187,557

[22] Filed: Nov. 6, 1998

[51] Int. Cl.[7] ..... H01Q 17/00

[52] U.S. Cl. ..... 342/2; 342/1

[58] Field of Search ..... 342/1, 2; 181/284, 181/295, 285, 290

[56] References Cited

U.S. PATENT DOCUMENTS

| | | | |
|---|---|---|---|
| 4,038,660 | 7/1977 | Connolly et al. | 342/1 |
| 5,192,810 | 3/1993 | Hill | 521/52 |
| 5,576,710 | 11/1996 | Broderick et al. | 342/1 |
| 5,731,777 | 3/1998 | Reynolds | 342/4 |

*Primary Examiner*—Ian J. Lobo
*Attorney, Agent, or Firm*—Christensen O'Connor; Johnson & Kindness PLLC

[57] ABSTRACT

An RF absorber system (26) for absorbing RF energy in the payload chamber (20) of a launch vehicle is disclosed. The RF absorber system (26) includes a plurality of panels (27) for providing acoustic absorption and for housing RF absorbing material. The panels (27) comprise a plurality of acoustic absorbing layers (30*a*, 30*b*, and 30*c*) and at least two RF energy absorbing sheets (36*a* and 36*b*) for absorbing RF energy, and an outer film layer (38) for dissipating static charges and acting as a contaminant barrier. The panels (27) have an outer surface (32) and an inner surface (34). The RF energy absorbing sheets (36*a* and 36*b*) are sandwiched between the plurality of acoustic absorbing layers (30*a*, 30*b*, and 30*c*), thus creating alternating acoustic absorbing layers and RF energy absorbing sheets. The outer film layer (38) is secured to the outer surface (32) of the panel (27).

40 Claims, 3 Drawing Sheets

RADIO FREQUENCY ABSORBER SYSTEM

FIELD OF THE INVENTION

This invention relates to radio frequency (RF) absorber systems and, more particularly, to RF absorber systems for launch vehicle payload chambers.

BACKGROUND OF THE INVENTION

Launch vehicle payload chambers often carry communication satellites. Prior to launch, it is often necessary to check the operation of communication satellites located inside of payload chambers. Checking the operation of a communication satellite located inside of a payload chamber requires an antenna on the communication satellite to transmit data to a pick-up antenna located inside the payload chamber. The data is then re-transmitted from the pick-up antenna to a re-radiating antenna located outside the payload chamber and then again to a ground terminal. Alternatively, the antenna on the communication satellite may communicate to a pick-up antenna located outside of the payload chamber through an RF transparent window located in the fairing of the payload chamber. Reflections off the interior side of the fairing of the payload chamber can cause the pick-up antenna, located either inside or outside of the payload chamber, to experience severe signal modeing. This modal behavior if undamped, can cause time smearing of digital data as well as nulling of the power transfer between the communication satellite antenna and the pick-up antenna.

The traditional approach for diminishing modal behavior in a payload chamber is to position the pick-up antenna inside the payload chamber and to use a cantilevered mounting bracket to move the pick-up antenna around inside the payload chamber and generally towards the communication satellite antenna until a positive link margin exists between the pick-up antenna on the inside wall of the payload chamber and the communication satellite antenna signal. Typically, this bracket can be up to six feet in length. This approach suffers from at least three main problems. First, installation of the bracket and pick-up antenna can be complicated and time-consuming. Second, because the bracket is a movable part and because it generally extends toward the communication satellite, the use of the bracket creates an undesirable risk of hitting, and thus damaging, the communication satellite. Third, the use of the bracket adds unnecessary weight to the payload chamber and thus increases launch vehicle thrust requirements.

Therefore, there exists a need for an RF absorber system that addresses the above issues, is simple, lightweight, and reliable, and saves operational time.

SUMMARY OF THE INVENTION

In accordance with this invention, an RF absorber system that absorbs both acoustic and RF energy in a launch vehicle payload chamber is provided. The RF absorber system comprises a plurality of panels, each of which includes: a plurality of acoustic absorption layers; a plurality of RF energy absorbing sheets; and an outer film layer. The RF energy absorbing sheets are sandwiched between the acoustic absorption layers creating alternating acoustic absorption layers and RF energy absorbing sheets. The sandwich formed by the acoustic absorption layers and the RF energy absorbing sheets has an outer surface and an inner surface that lies opposite the outer surface. The inner surface is attached to an interior wall of the launch vehicle payload chamber and, preferably, is curved to correspond with any curvature of the interior wall so that the RF absorber system is juxtaposed against the interior wall. The sandwiching of the acoustic absorption layers and the RF energy absorbing sheets is such that the outer member of the sandwich is an acoustic absorption layer and the inner member is also an acoustic absorption layer. The outer film layer is secured to the outer surface of the sandwich and, preferably, to the side surfaces of the sandwich as well as a portion of each of the upper, lower and inner surfaces of the sandwich. The outer film layer dissipates static charge and provides a barrier that prevents the acoustic absorption layers from contaminating the interior of the launch vehicle payload chamber.

In accordance with further aspects of this invention, the exterior surface of the sandwich is covered with a filter coating that assists in preventing the acoustic absorption layers from decomposing and contaminating the interior of the launch vehicle payload chamber.

In accordance with additional aspects of this invention, the outer film layer is secured to a portion of both the upper surface and lower surface of the sandwich such that the portion of the upper surface and lower surface that remains uncovered effectively creates an elongate vent that extends from the upper surface to the lower surface of the sandwich.

In accordance with other aspects of the invention, the RF absorber system also includes a grounding mechanism. The grounding mechanism is connected to the outer film layer. Preferably, the grounding mechanism includes a plurality of grounding tabs each of which is secured to one of the edges of the sandwich and partially to the outer and inner surfaces of the sandwich, between the sandwich and the outer film layer. The grounding tabs are connected to the wall of the launch vehicle payload chamber by grounding tab extensions.

In accordance with still further aspects of the invention, the acoustic absorption layers are formed of a foam material, preferably polyimide foam.

In accordance with yet other aspects of this invention, the RF energy absorbing sheets are metal coated polyimide polymer sheets.

In accordance with yet still other aspects of this invention, the outer film layer is a metal coated polyimide polymer layer.

As will be readily appreciated from the foregoing description, the invention provides an RF absorber system comprising a plurality of panels that, after being secured to the interior wall of a launch vehicle payload chamber, perform multiple functions, most importantly reducing signal modeing within the launch vehicle payload chamber prior to launch. The RF energy absorbing sheets included in the panel absorb RF energy created by a signal transmitted by a communication satellite located within the launch vehicle payload chamber, preventing significant interference with the signal and improving the quality of the signal received by a pick-up antenna located either interior or exterior to the launch vehicle payload chamber. Acoustic energy is absorbed by the acoustic absorption layers. The RF energy absorbing sheets and the acoustic absorption layers also provide thermal protection for a communication satellite located in the launch vehicle payload chamber. The outer film layer dissipates static charges, acts as a contaminate barrier and assists in grounding the RF absorber system. An RF absorber system formed in accordance with the invention is simple, reliable, lightweight, and inexpensive.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
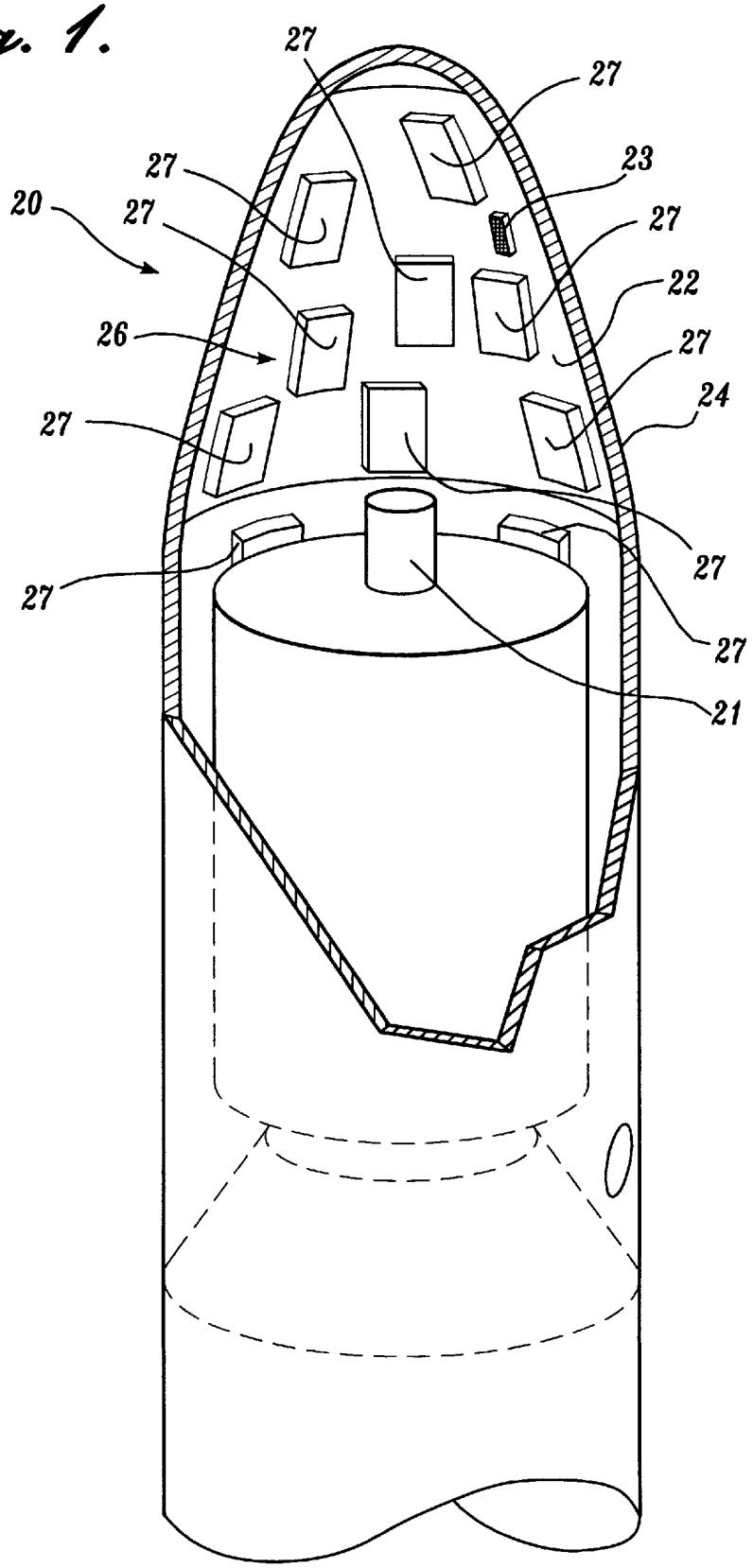
FIG. 1 is a pictorial view of a payload launch vehicle depicting an RF absorber system formed in accordance with this invention secured to an interior wall of the fairing of a launch vehicle payload chamber.

The present invention is an RF absorber system for use inside a payload chamber of a launch vehicle. FIG. 1 illustrates a launch vehicle payload chamber 20 defined by a payload fairing 24. Located inside of the launch vehicle payload chamber is a communication satellite antenna 21. A pick-up antenna 23 is shown mounted to the interior wall 22 of the payload fairing 24. Alternatively, instead of a pick-up antenna, an RF transparent window (not shown) could be positioned on the interior wall 22 of the payload fairing 24 permitting the communication satellite antenna 21 to communicate with an antenna exterior to the payload chamber. Also shown attached to the interior wall 22 of the payload fairing 24 is RF absorber system 26 formed in accordance with this invention. The RF absorber system 26 comprises a plurality of panels 27 interspersed over the interior wall 22 of the payload fairing 24. It will be appreciated that the amount of the surface area of the interior wall 22 that is covered by the panels 27 will vary depending upon the percentage of RF energy that needs to be absorbed by the RF absorber system 26. Preferably, at least 60% of the interior wall 22 is covered with panels 27. While the panels can have various shapes, for ease of construction and assembly, preferably they have a generally rectangular shape. If desired, some of the panels may have a trapezoidal or other shape depending upon the nature and shape of the interior wall 22 of the payload fairing 24.

Figure 2:
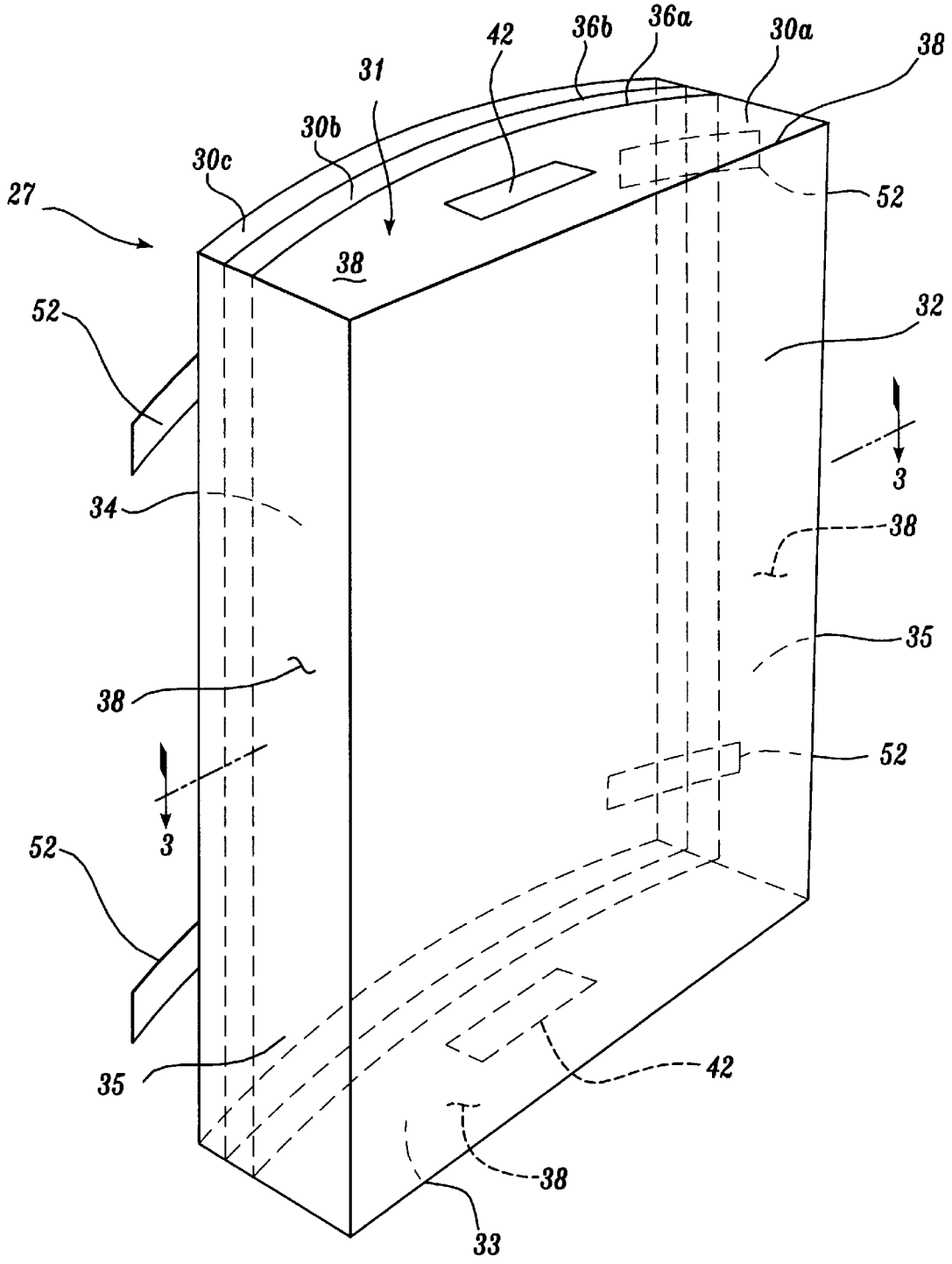
FIG. 2 is a perspective view of a panel of an RF absorber system formed in accordance with the present invention.

As shown in a perspective view in FIG. 2, each of the panels 27 of the RF absorber system 26 includes a plurality of acoustic absorption layers 30*a,* 30*b,* and 30*c,* a plurality of RF energy absorbing sheets 36*a* and 36*b,* and an outer film layer 38. The panel 30 further includes a vent opening 42.

The acoustic absorption layers 30*a,* 30*b,* and 30*c* and the RF energy absorbing sheets 36*a* and 36*b* are layered such that the RF energy absorbing sheets 36*a* and 36*b* are sandwiched between the acoustic absorption layers 30*a,* 30*b,* and 30*c*. The sandwich formed by the acoustic absorption layers 30*a,* 30*b* and 30*c* and the RF energy absorbing sheets 36*a* and 36*b* includes an outer surface 32 and an inner surface 34 opposite the outer surface 32, and an upper surface 31 and a lower surface 33 opposite the upper surface 31. The outer surface 32 is defined by one of the acoustic absorption layers 30*a* and the inner surface 34 is defined by another acoustic absorption layer 30*c*. The outer film layer 38 is secured to the outer surface 32, the upper surface 31, the lower surface 33, the side surfaces 35 and a portion of the inner surface 34, of the sandwich. A portion of the outer film layer on both the upper surface 31 and the lower surface 33 is eliminated so that the vent opening 42 is created, as shown in FIG. 2. Since the acoustic absorption layers are preferably formed from an open cell material, i.e., foam, as described below, by eliminating a portion of the outer film layer 38 on both the upper surface 31 and lower surface 33, an elongate vent which extends from the upper surface 31 to the lower surface 33 of the sandwich is effectively created.

The acoustic absorption layers 30*a,* 30*b,* and 30*c* are formed of a relatively thick, suitably rigid, non-metallic material, such as thermal insulating foam material, preferably polyimide foam. The RF energy absorbing sheets 36*a* and 36*b* are formed of a suitable RF resistive material, such as a polyimide polymer sheet with a metallic coating. The choice of the metallic coating is governed by the degree of surface resistivity required for the system to absorb RF energy within a desired frequency range. Suitable metal coatings are chromium, palladium, aluminum and carbon. The outer film layer 38 is formed of a thin, clean, conductive material, such as a polyimide polymer sheet with a metallic coating. The metallic coating for the outer film layer 38 must have a high enough surface resistivity to allow RF energy to pass through the outer film layer 38 and also a low enough surface resistivity to dissipate static charges. Preferably, a suitable metal coating is chromium.

Alternatively, the RF energy absorbing sheets 36*a* and 36*b* and the outer film layer 38 can be formed in various other ways. For example, carbon particles can themselves be mixed within plastic, i.e., a polyimide substrate, and extrude into sheets or film. Furthermore, zinc or other metals can be sputtered onto polyimide film, woven cloth, or even printer paper to create the RF energy absorbing sheets or the outer film layer. Finally, the polyimide film or woven cloth could alternatively be coated with a liquid containing carbon particles.

The acoustic absorption layers 30*a,* 30*b,* and 30*c,* the RF energy absorbing sheets 36*a* and 36*b,* and the outer film layer 38 are secured to one another by any suitable attachment mechanism. Preferably these elements are bonded together by a suitable adhesive. The inner surface 34 of the sandwich is secured to the interior wall 22 of the payload fairing 24 by any suitable attachment mechanism. Preferably, the panels 27 are bonded to the interior wall of the payload fairing by a suitable adhesive.

Because the inner surfaces 34 of the sandwiches are secured to the interior wall 22 of the payload fairing 24, preferably, these surfaces conform to the shape of the interior wall 22 where they are to be attached. In most instances, the shape of the inner surface 34 is slightly convex. In contrast, the outer surface 32, the upper surface 31, the lower surface 33 and the side surfaces 35 of the sandwich are preferably flat.

During launch, when the panels 27 are secured to the interior wall 22 of the payload fairing 24, the panels 27 primarily function as an acoustic absorber. The panels 27 also provide thermal protection. Preferably, as mentioned above, the panels 27 are formed of a foam material that has good thermal insulation and acoustic absorption properties. In one actual embodiment of the invention, the panels 27 are formed of a polyimide foam.

The elongate vent, effectively created within the panels 27 through the vent opening 42 by eliminating a portion of the outer film surface 38 on the upper surface 31 and lower surface 33 of the sandwich, assists in making the panels function properly. In particular, the elongate vent allows air trapped inside the panels 27 to escape during ascent and prevents the panels from exploding during launch due to changes in pressure that occur inside of the launch vehicle payload chamber 20 during launch.

Articles made of foam, such as polyimide foam, can partially disintegrate when handled in a rough manner or when exposed to a rough environment and, thus, often contain small loose particles. These loose particles could undesirably contaminate the launch vehicle payload chamber 20. The invention avoids this problem by encapsulating the sandwich created by the acoustic absorption layers 30*a,* 30*b,* and 30*c* and the RF energy absorbing layers 36*a* and 36*b* with a filter coating. Preferably, the outer surface 32, the upper surface 31, the lower surface 33 and the side surfaces 35 of the sandwiches are filter coated. Although not necessary since the inner surface 34 is secured to the interior wall 22 of the payload fairing 24, the inner surface 34 can also be filter coated, if desired. A suitable filter coating is polymer fiber media, preferably having a 3 micron filter size.

Figure 3:
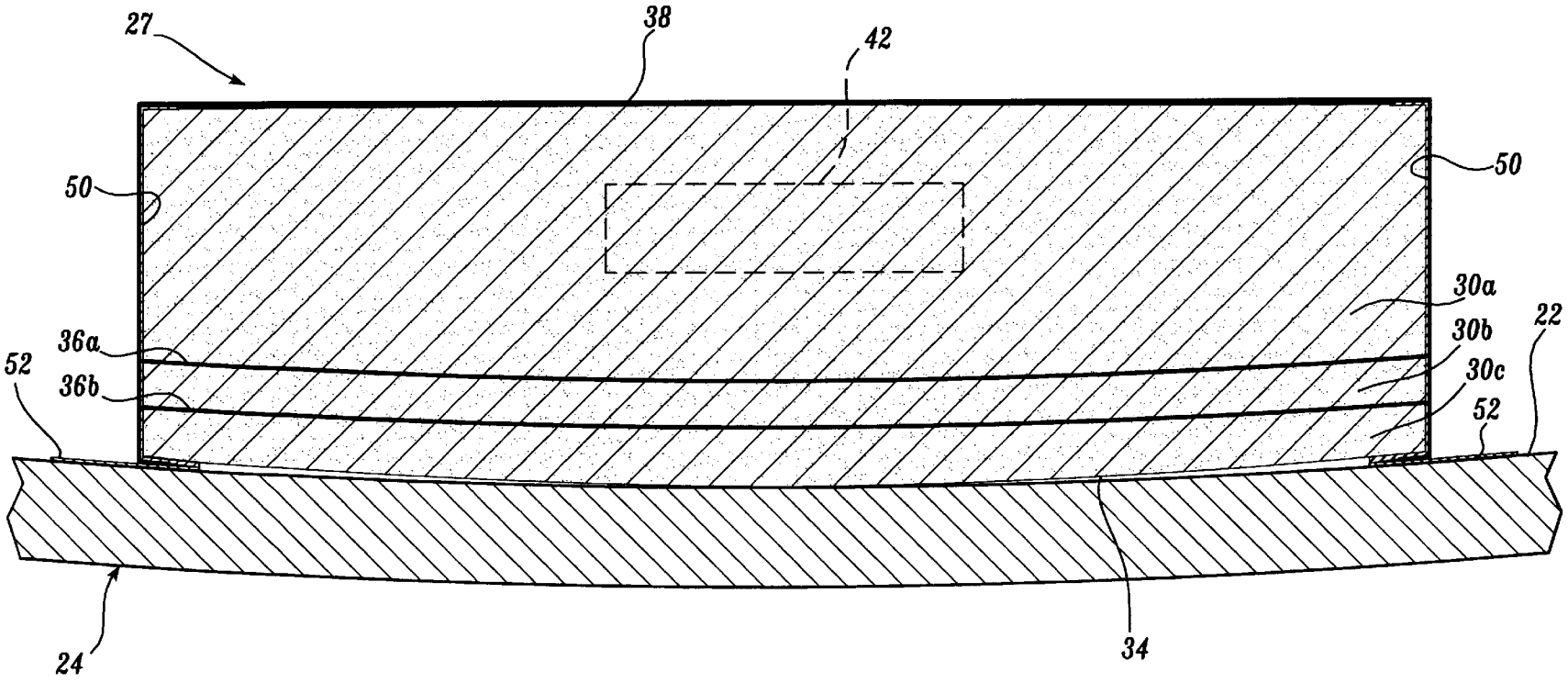
FIG. 3 is a cross-sectional view along line 3—3 of the RF absorber system panel shown in FIG. 2 secured to an interior wall of the fairing of a launch vehicle payload chamber.

FIG. 3 is a cross-sectional view of an RF absorber system panel 27 secured to the interior wall 22 of the payload fairing 24. As shown in FIG. 3 and described above, the RF energy absorbing sheets 36*a* and 36*b* are layered within the panels 27 between the outer surface 32 and the inner surface 34 such that a sandwich comprising alternating acoustic absorbing layers and RF energy absorbing sheets are created. The RF energy absorbing sheets 36*a* and 36*b* are thin layers that extend longitudinally from the upper surface 31 to the lower surface 33 of the sandwiches and laterally from one side of the sandwiches to the other side. The RF energy absorbing sheets 36*a* and 36*b* lie parallel to one another and are separated by an intermediate acoustic absorption layer 30*b*.

The RF energy absorbing sheets 36 are RF resistive and primarily function to absorb RF energy within the launch vehicle payload chamber 20 to prevent signal modeing and, thus, interference with signal transmission between the communication satellite antenna 21 and the pick-up antenna 23 or an antenna exterior to the payload chamber 20 prior to and during launch. While the RF energy absorbing sheets may also provide some thermal protection, their primary function is RF energy absorption.

The number of RF energy absorbing sheets, the location of the RF energy absorbing sheets 36 within a panel and the surface resistivity values of the RF energy absorbing sheets 36 all depend on the frequency range of the RF energy which is to be absorbed. As will be readily appreciated by one skilled in the art, the optimum number, location and surface resistivity values of the RF energy absorbing sheets can be determined by summing all reflection coefficients in the desired frequency range. For the 5–18 Gigahertz range, two RF energy absorbing sheets 36*a* and 36*b* layered within a panel 27 are adequate. In one actual embodiment of the invention, one RF energy absorbing sheet 36*a* is layered within the panel 27 approximately 0.55 inches from the inner surface 34 of the sandwich. This RF energy absorbing sheet 36*a* has a surface resistivity of 970 ohms/square. The other RF energy absorbing sheet 36*b* is layered approximately 0.275 inches from the inner surface 34 of the sandwich. This RF energy absorbing sheet 36*b* has a surface resistivity of 270 ohms/square. The total thickness of an RF absorber system panel formed in accordance with the invention can vary over a wide range since the thickness of the acoustic absorption layer that defines the outer surface 32 of the sandwich does not significantly affect the performance of the RF energy absorbing sheets 36*a* and 36*b*. In one actual embodiment of the invention, the thickness of the RF absorber system panels is 3.0 inches. As noted above, the RF energy absorbing sheets are preferably made of a polyimide polymer which is covered with a metallic coating that provides the required surface resistivity. In one actual embodiment, the polyimide polymer is Kapton and the metallic coating is chromium.

As shown in FIGS. 2 and 3, the outer film layer 38 is secured to the outer surface, the side surfaces, a portion of both of the upper surface and the lower surface, and a small portion of the inner surface of the sandwich formed by the acoustic absorption layers 30*a,* 30*b* and 30*c* and the RF energy absorbing sheets 36*a* and 36*b*. The outer film layer 38 provides a conductive path that allows the RF absorber system panels 27 to be grounded, thus dissipating static charges. The outer film layer 38 is also preferably made from a polyimide polymer sheet, such as Kapton, covered with a metallic coating. The metallic coating of the outer film layer 38 needs to have a high enough resistive value to allow RF energy to pass through the layer and a low enough resistive value to dissipate static charges. A suitable metal is chromium.

Since the outer film layer 38 also acts as a contaminant barrier, the sandwich formed by the acoustic absorption layers 30*a,* 30*b* and 30*c* and the RF energy absorbing sheets 36*a* and 36*b* need not be covered with the previously described filter coating where the sandwich is covered by the outer film layer 38, although completely filter coating the sandwich is preferred. Furthermore, although the outer film layer 38 is shown as covering the outer surface 32, the upper surface 31, the lower surface 33, the side surfaces 35 and a portion of the inner surface 34 of the sandwich, the outer film layer 38 does not have to cover all of these surfaces. In order to perform its function, the outer film layer 38 only needs to cover (and be secured to) the outer surface 32 of the sandwich. In this instance, the entire upper surface 31 and lower surface 33 of the sandwich formed by the acoustic absorption layers 30*a,* 30*b* and 30*c* function as a vent opening, creating an elongate vent throughout the entire sandwich from the upper surface 31 to the lower surface 33.

As indicated above, one of the primary goals of the outer film layer 38 is to ground the RF absorber system panels 27. This goal is accomplished by a grounding mechanism that is attached to the outer film layer 38. The more contact the grounding mechanism has with the outer film layer 38 the stronger the grounding connection is. In order to provide large contact areas, the grounding mechanism includes a plurality of grounding tabs 50 and grounding tab extensions 52, both formed of electrical conducting material. The grounding tabs 50 electrically bond to the side surfaces 35 of the sandwich formed by the acoustic absorption layers 30*a,* 30*b* and 30*c* and the RF energy absorbing sheets 36*a* and 36*b* and partially bond to the ends of the outer surface 32 and inner surface 34 of the sandwich. These grounding tabs 50 are positioned between the sandwich and the outer film layer 38. The grounding tab extensions 52 are secured to, and in electrical contact with, the portion of the grounding tabs that partially encloses the inner surface 34 of the sandwich formed by the acoustic absorption layers 30*a,* 30*b* and 30*c* and the RF energy absorbing sheets 36*a* and 36*b*. The grounding tab extensions are attached to, and in electrical contact with, the interior wall 22 of the payload fairing 24. It will be appreciated by one skilled in the art that many other grounding mechanisms could be used to ground the RF absorber system panels 27. Thus, the illustrated and described grounding mechanism should be considered as exemplary, not limiting.

As will be readily appreciated by those skilled in the art and others, an RF absorber system formed in accordance with this invention has a number of advantages. First, covering a good percentage of the surface area of the interior wall of the payload fairing with multiple RF absorber system panels results in a significant percentage of the RF energy emitted from the communication satellite antenna 21 being absorbed. As a result, the RF absorber systems effectively eliminate severe modal behavior within the payload fairing.

As a result, reflective signal interference with signals passing between the communication satellite antenna 21 and the pick-up antenna 23, or an antenna exterior to the payload chamber 20, is substantially reduced, if not entirely eliminated. Additionally, the RF absorber system provides thermal protection and absorbs acoustic noise within the launch vehicle payload chamber. Further, an RF absorber system formed in accordance with this invention is simple, reliable, lightweight, inexpensive and easy to install.

While the preferred embodiment of the invention has been illustrated and described, it should be understood that various changes can be made therein without departing from the spirit and scope of the invention as defined by the appended claims. For example, the overall shape of the RF absorber system, in particular, the shape of the panels, may be altered to suit the needs within the launch vehicle payload chamber. Furthermore, as mentioned above, the number, location and resistive values of the RF energy absorbing sheets may be varied depending upon the frequency range of the signal from which RF energy is desired to be absorbed. Also as mentioned above, the outer film layer may cover only the outer surface of the panel, or alternatively, it may cover some or all of the exterior surfaces of the panel. Thus, within the scope of the appended claims, it is to be understood that the invention can be practiced otherwise than as specifically described herein.

The embodiments of the invention in which an exclusive property or privilege is claimed are defined as follows:

1. An RF absorber system for use inside a launch vehicle payload chamber, the launch vehicle payload chamber having a payload fairing, the payload fairing having an interior wall, the RF absorber system comprising at least one panel, said panel including:

a) a sandwich, having an outer surface and an inner surface, formed of:
   (i) a plurality of acoustic absorption layers; and
   (ii) at least two RF energy absorbing sheets sandwiched between said plurality of acoustic absorption layers; and b) an outer film layer secured to the outer surface of said sandwich.

2. The RF absorber system of claim 1, wherein said plurality of acoustic absorption layers are formed of foam.

3. The RF absorber system of claim 2, wherein said foam is a polyimide foam.

4. The RF absorber system of claim 2, wherein the exterior surfaces of the sandwich formed by said plurality of acoustic absorption layers and said at least two RF energy absorbing sheets are coated with a filtering material that prevents contaminants from leaving said at least one panel.

5. The RF absorber system of claim 4, wherein said sandwich has an upper surface and a lower surface and wherein said outer film layer encloses a portion of said upper surface and a portion of said lower surface of said sandwich, effectively creating an elongate vent extending from the unenclosed portion of said upper surface of said sandwich to the unenclosed portion of said lower surface of said sandwich.

6. The RF absorber system of claim 5, wherein said sandwich has two side surfaces and wherein said outer film layer further encloses said two side surfaces of said panel.

7. The RF absorber system of claim 1, wherein said RF energy absorbing sheets are polyimide polymer sheets having a metallic coating.

8. The RF absorber system of claim 1, wherein a first of said at least two RF energy absorbing sheets has a surface resistivity of approximately 920 ohms per square.

9. The RF absorber system of claim 8, wherein a second of said at least two RF energy absorbing sheets has a surface resistivity of approximately 270 ohms per square.

10. The RF absorber system of claim 9, wherein the second of said two RF energy absorbing sheets is located approximately 0.275 inches from said inner surface of said panel.

11. The RF absorber system of claim 10, wherein the first of said two RF energy absorbing sheets is located approximately 0.275 inches from said second of said two RF energy absorbing sheets.

12. The RF absorber system of claim 1, wherein said outer film layer is a polyimide polymer layer having a metallic coating with a high enough surface resistivity to allow RF energy to pass through said layer and a low enough surface resistivity to dissipate static charges.

13. The RF absorber system of claim 1, wherein said panel has two side surfaces and wherein said outer film layer encloses said two side surfaces of said panel.

14. The RF absorber system of claim 13, wherein said outer film layer further encloses said inner surface of said sandwich.

15. The RF absorber system of claim 1, wherein said inner surface of said sandwich conforms to the shape of said interior wall of a launch vehicle payload chamber where said panel is to be secured.

16. The RF absorber system of claim 15, wherein said inner surface of said sandwich is secured to the interior wall of a launch vehicle payload chamber.

17. The RF absorber system of claim 16, wherein said panel is secured to said interior wall of said launch vehicle payload chamber by an adhesive film.

18. The RF absorber system of claim 1, further comprising a grounding mechanism connected to said outer film layer.

19. The RF absorber system of claim 18, wherein said panel has two side surfaces and wherein said grounding mechanism encloses at least one of said side surfaces of said sandwich and is attached to the interior wall of a launch vehicle payload chamber.

20. The RF absorber system of claim 19, wherein said grounding mechanism further encloses the other of said side surfaces of said sandwich and is attached to the interior wall of said launch vehicle payload chamber.

21. In an internal cavity of a vehicle, the internal cavity having an interior wall, the improvement comprising an RF absorber system comprising at least one panel, said panel including:

a) a sandwich, having an outer surface and an inner surface, formed of:
   (i) a plurality of acoustic absorption layers; and
   (ii) at least two RF energy absorbing sheets sandwiched between said plurality of acoustic absorption layers; and b) an outer film layer secured to the outer surface of said sandwich.

22. The improvement claimed in claim 21, wherein said plurality of acoustic absorption layers are formed of foam.

23. The improvement claimed in claim 22, wherein said foam is a polyimide foam.

24. The improvement claimed in claim 22, wherein the exterior surfaces of the sandwich formed by said plurality of acoustic absorption layers and said at least two RF energy absorbing sheets are coated with a filtering material that prevents contaminants from leaving said at least one panel.

25. The improvement claimed in claim 24, wherein said sandwich has an upper surface and a lower surface and wherein said outer film layer encloses a portion of said upper surface and wherein said outer film layer encloses a portion of said upper surface and a portion of said lower surface of said sandwich, effectively creating an elongate vent extending from the unenclosed portion of said upper surface of said sandwich to the unenclosed portion of said lower surface of said sandwich.

26. The improvement claimed in claim 25, wherein said sandwich has two side surfaces and wherein said outer film layer further encloses said two side surfaces of said panel.

27. The improvement claimed in claim 21, wherein said RF energy absorbing sheets are polyimide polymer sheets having a metallic coating.

28. The improvement claimed in claim 21, wherein a first of said at least two RF energy absorbing sheets has a surface resistivity of approximately 920 ohms per square.

29. The improvement claimed in claim 28, wherein a second of said at least two RF energy absorbing sheets has a surface resistivity of approximately 270 ohms per square.

30. The improvement claimed in claim 29, wherein the second of said two RF energy absorbing sheets is located approximately 0.275 inches from said inner surface of said panel.

31. The improvement claimed in claim 30, wherein the first of said two RF energy absorbing sheets is located approximately 0.275 inches from said second of said two RF energy absorbing sheets.

32. The improvement claimed in claim 21, wherein said outer film layer is a polyimide polymer layer having a metallic coating with a high enough surface resistivity to allow RF energy to pass through said layer and a low enough surface resistivity to dissipate static charges.

33. The improvement claimed in claim 21, wherein said panel has two side surfaces and wherein said outer film layer encloses said two side surfaces of said panel.

34. The improvement claimed in claim 33, wherein said outer film layer further encloses said inner surface of said sandwich.

35. The improvement claimed in claim 21, wherein said inner surface of said sandwich conforms to the shape of said interior wall of an internal cavity where said panel is to be secured.

36. The improvement claimed in claim 35, wherein said inner surface of said sandwich is secured to the interior wall of an internal cavity.

37. The improvement claimed in claim 36, wherein said panel is secured to said interior wall of said internal cavity by an adhesive film.

38. The improvement claimed in claim 21, further comprising a grounding mechanism connected to said outer film layer.

39. The improvement claimed in claim 38, wherein said panel has two side surfaces and wherein said grounding mechanism encloses at least one of said side surfaces of said sandwich and is attached to the interior wall of an internal cavity.

40. The improvement claimed in claim 39, wherein said grounding mechanism further encloses the other of said side surfaces of said sandwich and is attached to the interior wall of said internal cavity.

* * * * *

UNITED STATES PATENT AND TRADEMARK OFFICE

CERTIFICATE OF CORRECTION

PATENT NO. : 6,097,327

DATED : August 1, 2000

INVENTOR(S) : T.A. Byquist et al.

It is certified that error appears in the above-identified patent and that said Letters Patent is hereby corrected as shown below:

| COLUMN | LINE | |
|---|---|---|
| [56] Pg. 1, col. 1 | Refs. Cited (U.S. Pats.) | insert the following references in numerical order: |
| | | --5,081,455 1/1992 Inui et al. |
| | | 5,125,992 6/1992 Hubbard et al. |
| | | 5,173,699 12/1992 Barr et al. |
| | | 5,202,688 4/1993 Hubbard et al. |
| | | 5,214,432 5/1993 Kasevich et al. |
| | | 5,229,773 7/1993 Dauwen et al. |
| | | 5,488,371 1/1996 Targove-- |
| Pg. 1, col. 2 | Attorney, Agent, or Firm | after "O'Connor" delete ";" |

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*